US005172881A

United States Patent [19]

Stein

[11] Patent Number: 5,172,881

[45] Date of Patent: Dec. 22, 1992

[54] ADJUSTABLE DOCK SUPPORT

[76] Inventor: Robert J. Stein, 438 Clark St., Iowa City, Iowa 52240

[21] Appl. No.: 715,393

[22] Filed: Jun. 14, 1991

[51] Int. Cl.[5] ..... A47B 96/06

[52] U.S. Cl. ..... 248/231; 248/218.4

[58] Field of Search ..... 248/231, 230, 218.4, 248/219.3, 219.4, 74.3, 499

[56] References Cited

U.S. PATENT DOCUMENTS

| | | | |
|---|---|---|---|
| 1,502,031 | 7/1924 | Gray | 248/231 X |
| 1,849,789 | 3/1932 | Coffing | 248/231 |
| 2,499,753 | 3/1950 | Hubbard | 248/231 X |
| 2,959,388 | 11/1960 | Fogle | 248/231 |
| 4,079,481 | 3/1978 | Cacicedo | 248/230 X |
| 4,348,000 | 9/1982 | Hanner | 248/231 |
| 4,844,396 | 7/1989 | Norton | 248/231 |

*Primary Examiner*—Ramon O. Ramirez

*Attorney, Agent, or Firm*—Flynn, Thiel, Boutell & Tanis

[57] ABSTRACT

An adjustable dock support for a dock of the kind having an upstanding piling and a load carrying part including a member to be supported on the piling. The dock support comprises an elongate flexible member for at least partly enwrapping the piling at a desired height thereon. A base member is engageable with a portion of the perimeter of the piling opposite the flexible member. An over center lever member is pivoted with respect to the base member, from an open position to a closed position, and is engageable with the flexible member for tightly enlooping the piling and therewith snugly gripping the piling with the base member and flexible member. A carrier is fixed with respect to the base member for supporting a load carrying member of the dock.

18 Claims, 4 Drawing Sheets

ADJUSTABLE DOCK SUPPORT

FIELD OF THE INVENTION

This invention relates to an adjustable dock support and more particularly to one for supporting a dock for vertical adjustability on upstanding wood piles.

BACKGROUND OF THE INVENTION

It has long been known to support a dock on vertical wood pilings. Typically, two rows of pilings are driven, one row on each side of the intended dock, the rows extending the length of the dock. A pair of transverse beams, for example wood 2×6's or 2×8's or 2×10's, extend widthwise of the dock and are sandwichingly fixed to transversely opposite piles, one of each of the two rows, by spikes, lag screws or the like. This makes a row of generally H-shaped frames, each comprising two transversely opposite piles and their connecting transverse beams. Longitudinal joists extend lengthwise of the dock, adjacent the opposed inboard sides of the piles and are carried upon the transverse beams, to which they may (or may not) be fixed. The walkway, or horizontal surface of the dock, is then typically provided by horizontal cross planks supported atop the joists and running transversely thereof, and nailed or lag screwed thereto.

This makes a sturdy, practical, long lasting and reasonably inexpensive dock framework but one which cannot easily allow its walkway to be raised and lowered to meet substantial increases and decreases (for example seasonal ones or ones occurring over a cycle of several years). Unfortunately then, in docks of this kind, the walkway may at times be submerged under water or may be far enough above water level to make it inconvenient to step back and forth between boat and dock.

Accordingly, the objects and purposes of the present invention include provision of a dock support engageable with an upstanding piling for supporting a beam, and usually a pair of beams in straddling relation, with respect to such pile; in which such support can be adjusted up or down on the piling to provide for support of the dock beams, joists and cross planks, and thereby the walkway, at different heights, for example to accommodate substantial rises and falls in water level; in which the support is adaptable to pilings of a wide range of diameters and to a wide range of separations of straddling beams; in which the support is capable of strongly gripping a piling sufficient to prevent its sliding downward on the piling despite heavy downward loads applied thereto and to the dock supported thereby; in which the dock support is strongly built and capable of supporting heavy loads and thereby is usable in heavy duty docks; in which the support is readily and quickly installable with a minimum of instruction and no tools except a simple end notched lever or a common wrench; in which the support is easily constructible of commonly available materials without special tooling; in which the support is capable of a long operating life without attention and is capable of being adjusted in position on a piling many times; in which the support may be shifted from piling to piling or dock to dock as the need may arise; and in which plural ones of the supports are used to support a given dock, typically with one such support per piling.

Other objects and purposes of the invention will be apparent to persons acquainted with apparatus of this general type upon reading the following description and inspection of the accompanying drawings.

SUMMARY OF THE INVENTION

An adjustable dock support for a dock of the kind having an upstanding piling and a load carrying part including a member to be supported on the piling. The dock support comprises an elongate flexible member for at least partly enwrapping the piling at a desired height thereon. A base member is engageable with a portion of the perimeter of the piling opposite the flexible member. An over center lever member is pivoted with respect to the base member, from an open position to a closed position, and is engageable with the flexible member for tightly enlooping the piling and therewith snugly gripping the piling with the base member and flexible member. A carrier is fixed with respect to the base member for supporting a load carrying member of the dock.

DETAILED DESCRIPTION

Figure 8:
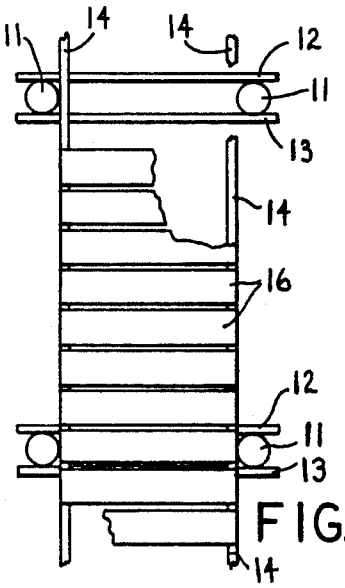
FIG. 8 is a schematic fragmentary top view of a typical pile supported dock with a portion or the planking broken away to show the supporting beams and joists.

A conventional dock 9, to which the present invention can be applied, is shown fragmentarily in FIG. 8, and includes piles 11, carrying fixed straddling beams 12, 13 in turn carrying longitudinal joists 14, in turn carrying fixed cross planks 16.

Figure 1:
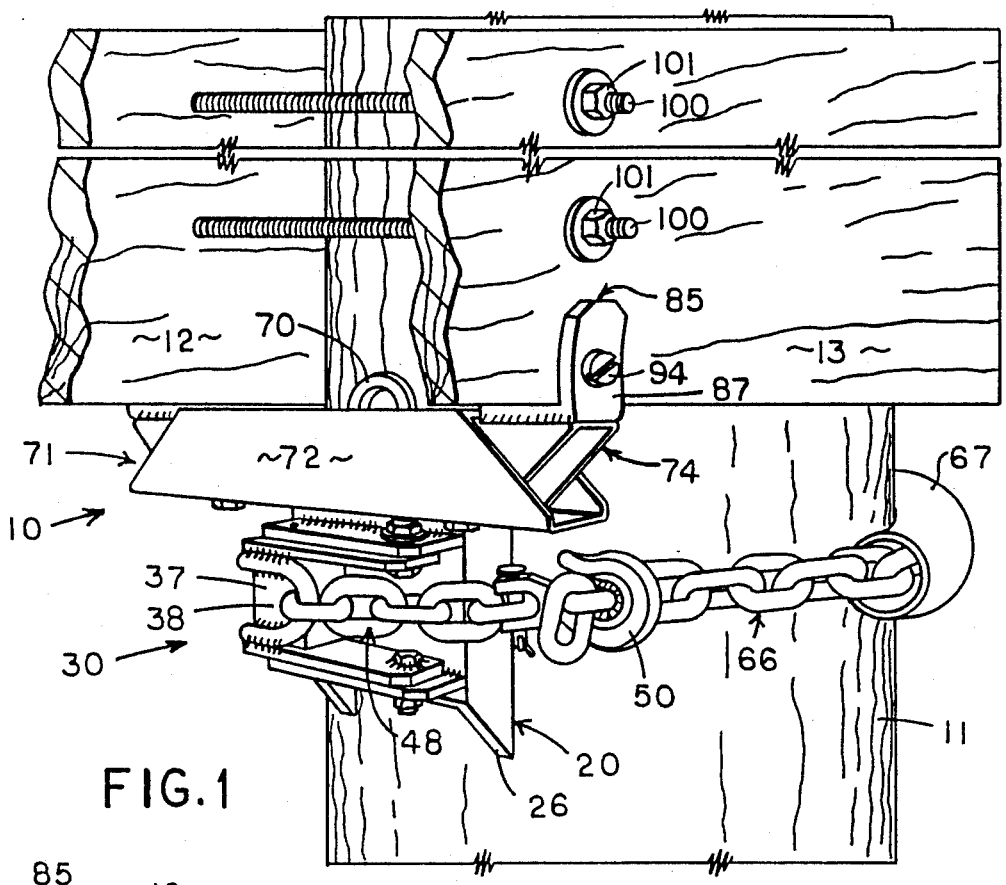
FIG. 1 is a pictorial view of a support embodying the invention secured on an upstanding piling and supporting two transverse beams straddling the piling and defining a part of a dock.

FIG. 1 shows a support 10 embodying the invention installed fixedly but adjustably on a conventional wood pile 11 and supporting fixedly a pair of horizontally extending transverse beams 12 and 13 extending in parallel to each other and closely sandwiching the upstanding pile 11 therebetween. The transverse beams 12 and 13 support the longitudinal joists 14 closely between transversely opposed piles 11, upon which are typically nailed or lag screwed the ends of transverse planks 14 in a manner not shown. It will be understood that in a given dock a plurality of upstanding piles 11 may each carry a support 10.

Figure 6:
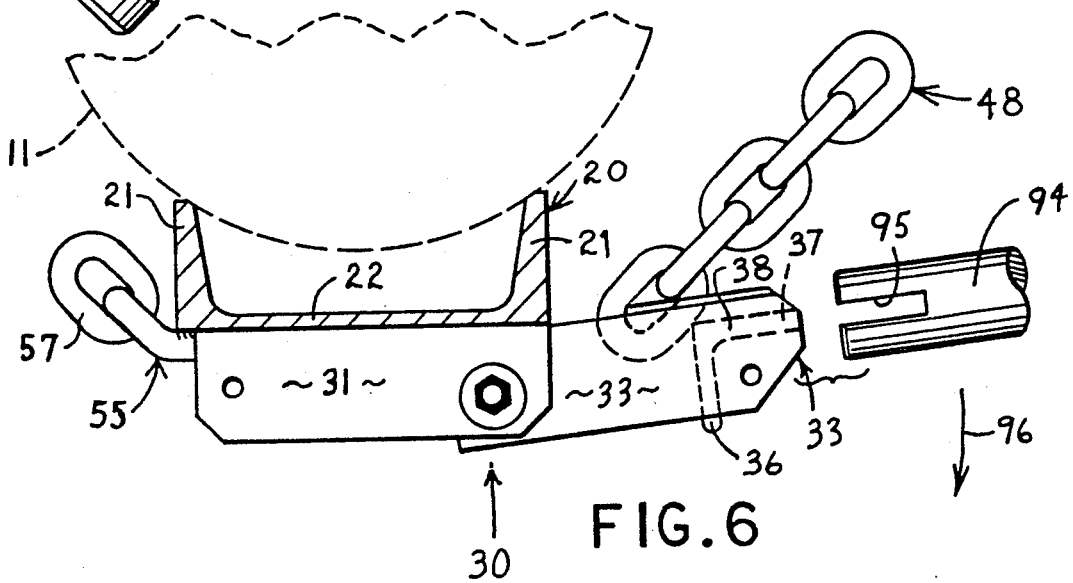
FIG. 6 is a view similar to FIG. 5 and showing the support in an untightened position.

The support 10, embodying the invention, comprises a base, preferably in the form of an upstanding channel member 20 (FIG. 6) having, in cross section, a pair of substantially parallel, spaced, opposed arms 21 rigidly connected to and extending forward from a bight 22. The bight 22 is substantially planar and, in the preferred embodiment shown, the channel member 20 is a cut length of standard extruded steel channel.

Figure 4:
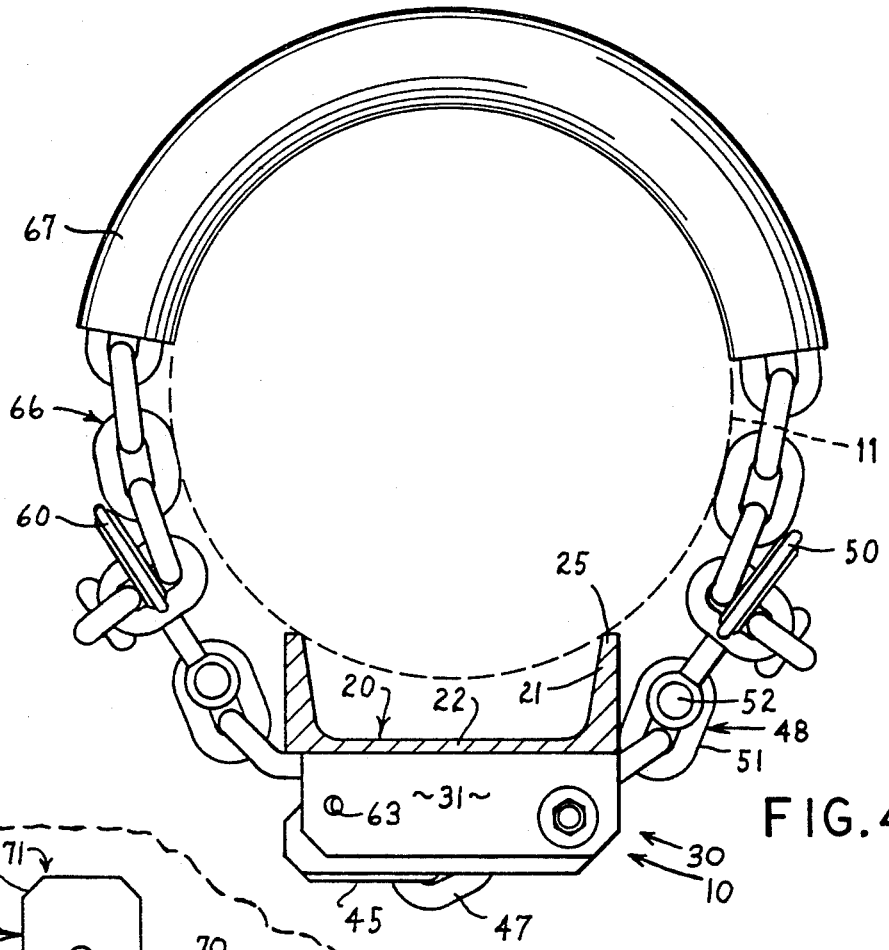
FIG. 4 is a top view of the support of FIG. 1.

The cross-sectional width of the channel member 20 is, as seen for example in FIG. 4, preferably about 20% to 60% the diameter of the piling 11 with which it is to be used. However, the support 10 may be used on piles of larger diameter. Further, the support 10 can be used on somewhat smaller piles although it is desired that the pile diameter not be so small as to allow the perimeter of the pile to contact the front surface of the bight 22 since that would tend to interfere with the solid engagement of the front edges of the arms 21 with the pile 11.

Figure 3:
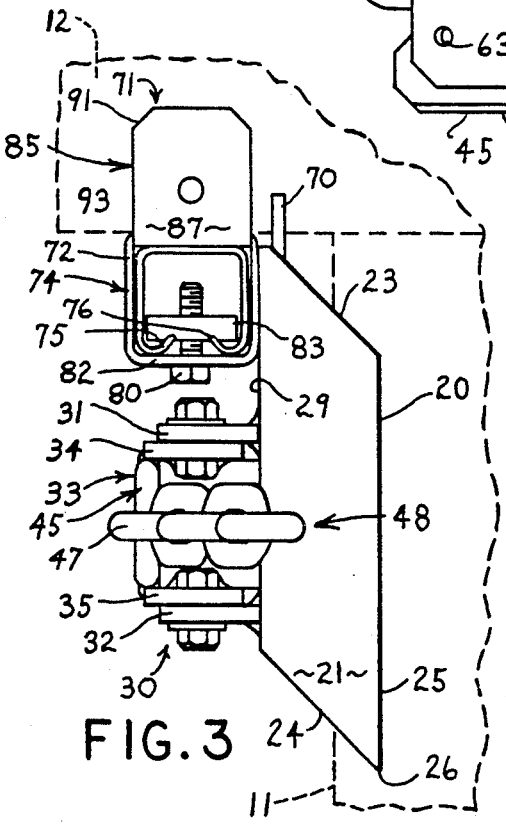
FIG. 3 is a right side elevational view of the FIG. 2 support.

The channel member 20 is cut at top and bottom so that the top and bottom edges 23 and 24, respectively, of the forward extending arms 21 are sloped at about a 45° angle to their length, as seen for example in FIG. 3. Accordingly, the bottom edge 24 of each arm 21 converges forwardly toward the upstanding front edge 25 (FIG. 3) thereof to form a downward extending point 26 (FIGS. 1 and 3). Thus, a downward force, such as the weight of the dock structure being supported, on the channel member 20 applies a counterclockwise (FIGS. 1 and 3) torque to the channel member 20 which tends to make the downward extending points 26 dig into the opposed surface of the pile 11. This tends to provide a mechanical interlock between the channel member 20 and the surface of the pile, to supplement the frictional holding force therebetween hereafter discussed.

A pile gripping unit 30, in the form of an over center latch, comprises horizontal, vertically spaced, top and bottom plates 31 and 32 (FIGS. 2 and 3) fixed to and extending rearward from the bottom portion of the rearward face 29 of the bight 22 of the channel member 20. In the preferred embodiment shown, the top and bottom plates 31 and 32 are welded to the bight 22.

Figure 2:
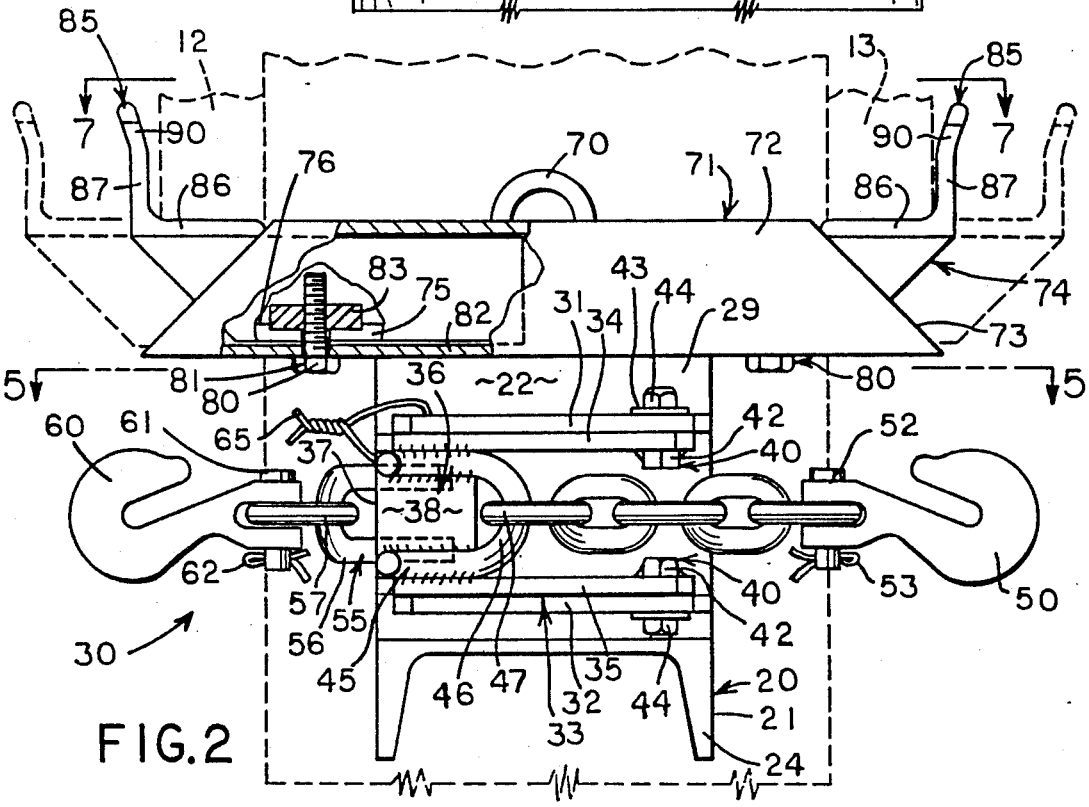
FIG. 2 is a front elevational view of the support of FIG. 1, with the pile surrounding chain omitted, and showing, in broken lines, an alternative adjustable width for accommodating an upstanding pile of a different width and thus a straddling beam spread of a different width.

The pile gripping unit 30 further includes a swing lever 33 (FIGS. 2, 3 and 5) which is generally U-shaped and rightward opening as seen from the rear in FIG. 2. The swing lever 33 comprises upper and lower plates 34 and 35 joined at their left (FIGS. 2 and 5) ends by a relatively short, vertically extending segment of a conventional angle element 36 forming a bight between the upper and lower plates 34 and 35. The angle element 36 has a rear flange 38 in turn having a free edge 37. The angle element 36 is fixed, here welded, between the left end portions of the upper and lower plates 34 and 35 to form the swing lever 33 as a rigid U-shaped structure.

The plates 34 and 35 of the swing lever 33 are a clearance fit between the plates 31 and 32 fixed to the channel member 20. Bolts 40 (FIG. 2) pivot the right ends of the plates 34 and 35 of the swing lever 33 on the right ends of the fixed plates 31 and 32 respectively. More particularly, the bolts 40 have shanks 41 (FIG. 5) which extend in coaxial vertical alignment through holes (not shown) in the rightward ends of the plates 31, 34 and 32, 35, respectively, to horizontally pivot the swing lever 33 on and between the fixed plates 31 and 33. In the particular embodiment shown, the bolts 40 extend away from each other. If desired, after assembly of the swing lever 33 on the plates 31 and 32, the heads 42 of the bolts 40 can be welded to the opposed inboard surfaces of the swing lever plates 34 and 35 as shown in FIG. 2. The bolts 40 are secured by washers 43 and lock nuts 44 at the top and bottom faces of the fixed plates 31 and 32 respectively. Should it be desired to be able, for any reason, to disassemble the swing lever 33 from the remainder of the pile gripping unit 30, the heads 42 of the bolts 40 need not be welded to the swing lever plates 34 and 35.

A U-shaped rod 45 (FIGS. 2, 3 and 5) opens leftwardly in FIG. 2 and is welded to the rear face of the rear flange 38 of the angle element 36. The bight 46 of the U-shaped rod 45 extends rightward just beyond the rightward end of the angle element 36 and forms a loop in which is captured the leftward link 47 of a short (here five link) chain 48, shown to extend rightward and forward from the channel member 20 in FIGS. 2–5.

A conventional chain hook 50 (FIGS. 2 and 4) is pivotally fixed to the rightwardmost link 51 of the chain 48 by a pivot pin 52 conventionally secured by a cotter pin 53.

Figure 5:
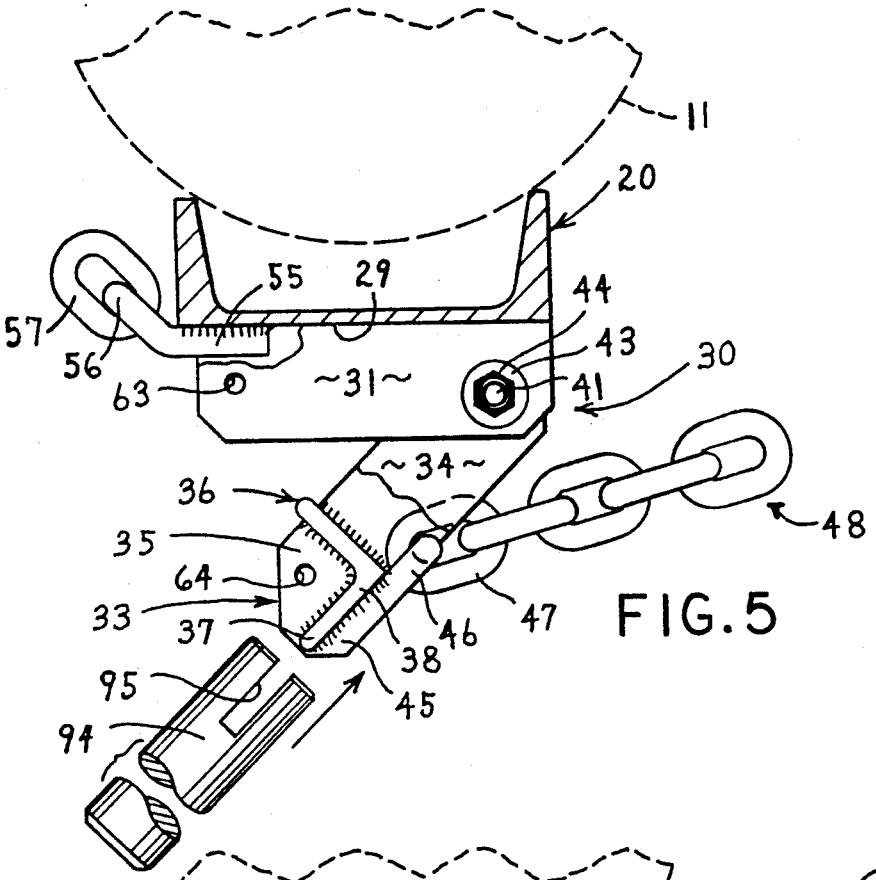
FIG. 5 is a partially broken sectional view substantially taken on the line V—V of FIG. 2 and showing the support in a partially tightened position.

A further U-shaped rod 55 (FIGS. 2 and 5) has its ends welded to the left edge portion of the rear face 29 of the channel member 20 ahead of the closed position of the rear flange 38 of the angle element 36. However, the rod 55 does not interfere with the angle element 36 of the swing lever 33 in its closed position in FIG. 6. The bight 56 of the U-shaped rod 55 extends leftward beyond the channel member 20 and is bent to angle leftwardly and forwardly as seen in FIG. 5. A chain link 57 is loosely captured within the bight 56 of the U-shaped rod 55. A second conventional chain hook 60 (FIGS. 2 and 4) is pivotally fixed to the link 57 by a pivot pin 61 conventionally secured by a cotter pin 62.

While the swing lever 33 should be, because of its over center configuration, stable in its closed position shown in FIGS. 1–4, nevertheless as an extra safety measure, there may be provided, if desired, holes 63 and 64 (FIG. 5) through the left end portions of the fixed plate 31 and adjacent swing lever plate 34. The holes 63 and 64 coaxially align in the closed (FIGS. 2 and 4) position of the over center swing lever 33 for reception therethrough of, for example, a safety wire, as shown at 65 in FIG. 2 twisted in a closed loop, or a cotter pin (not shown), or any other convenient through member capable of positively blocking counterclockwise swinging open, past its over center closed position, of the swing lever 33.

The pile gripping unit 30 is completed by a length of conventional chain 66 (FIGS. 1 and 4) engaging near its end in the hooks 50 and 60 and with its midportion surround the pile 11 in cooperation with the support 10. In the embodiment shown, to minimize damage by the chain 66 to the pile 11 and an adjacent boat (not shown), the major length of the chain 66 is sheathed in a flexible hose 67 of resilient plastic or rubber material, of any convenient commercial type.

A loop 70 (FIGS. 2 and 3) extends above the top of the channel member 20 and is fixed, as by welding to the central portion of the bight 22 of the channel member 20. By hanging the loop 70 on a previously appropriately located nail (not shown) protruding from the piling 11, the support 10 can be temporarily supported at a desired height on the piling, prior to tightening the grip of the chain 66 around the piling to fixedly secure the channel member 20 thereto, as hereafter discussed.

A carrier, here in the form of a saddle unit 71 upon which the beams 12 and 13 are to rest, comprises a tubular member 72, preferably of rectangular, here substantially square, cross section, which is fixed, as by welding, to the upper portion of the front face 29 of the channel member bight 22. The tubular member 72 is substantially wider than the channel member 20 and extends, in centered relation, horizontally thereacross. The ends 73 of the tubular member 72 are beveled at approximately a 45° angle to the horizontal, so as to face laterally outward and upward, as seen in FIG. 2.

Figure 7:
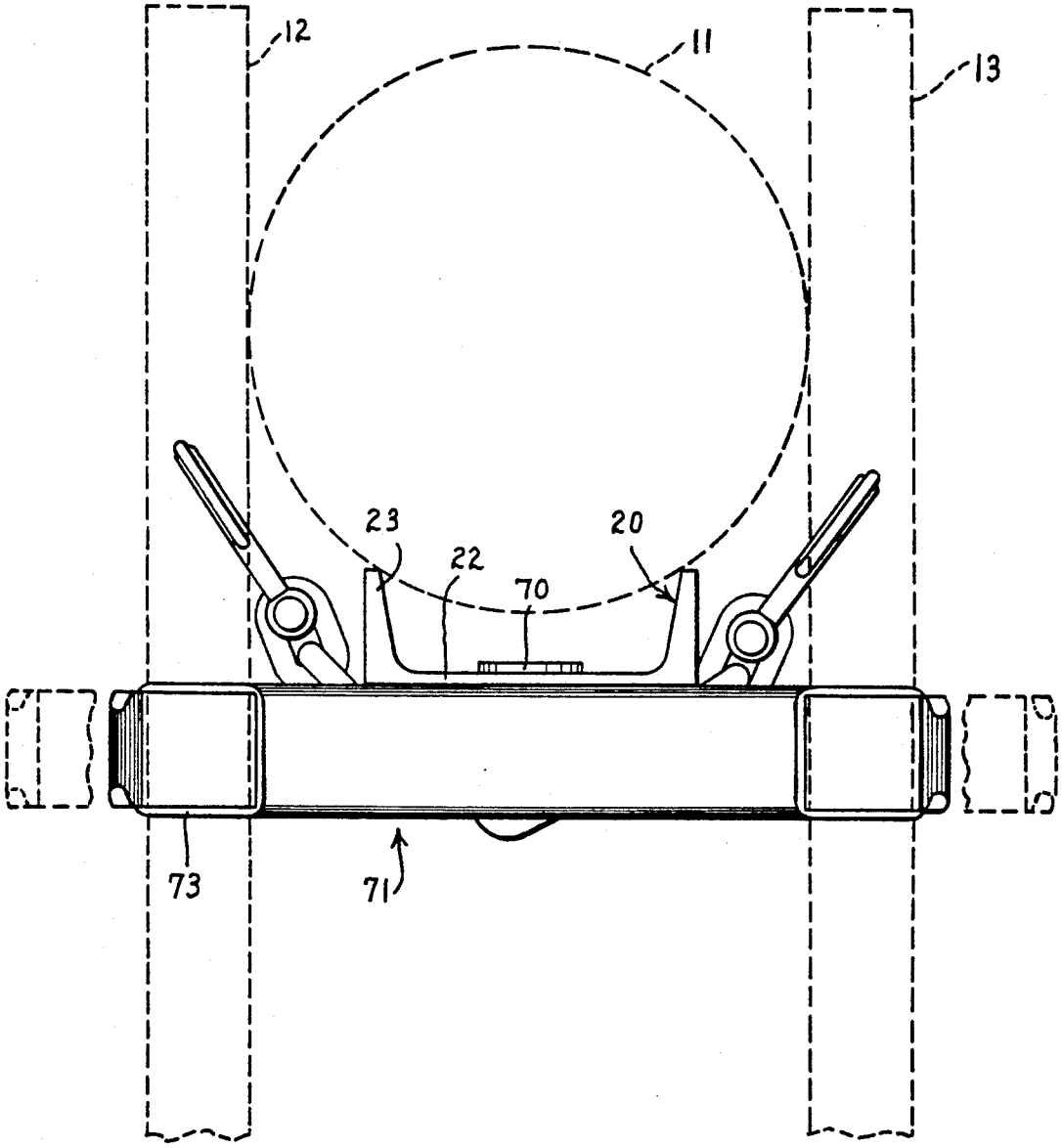
FIG. 7 is a bottom view of the apparatus of FIG. 2.

A pair of substantially identical sliders 74 (FIGS. 2, 3 and 7) are snugly but slidably disposed in the opposite end portions of the tubular member 72. Each of the sliders 74 is of substantially square cross section, substantially C-shaped, downwardly opening channel cross section at bottom having upward and inward angled lips 75 (FIG. 3) defining a downward opening central slot 76 therebetween. The left and right end portions of the tubular member 72 each have a cap screw 80 (FIGS. 2 and 3) extending centrally and freely rotatably upward each through a corresponding hole 81 (FIG. 2) in the bottom wall 82 thereof. Each cap screw 80 extends upward through the slot 76 defined between the lips 75 of the corresponding slider 74. Each of a pair of rectangular blocks 83 is provided with an internally threaded central vertical hole, and, in the manner of a nut, receives the corresponding cap screw 80 threadedly upward therethrough as seen in FIGS. 2 and 3. Each block 83 rides atop the lips 75 and, in the embodiment shown, is slightly grooved in the underside thereof to receive the lips a small distance thereinto. Each block 83 extends snugly but slidably across the width of the central opening of the slider 74. Thus, tightening a given cap screw 80 pulls the corresponding nut-like block 83 down hard against the tops of the lips 75 of the corresponding slider 74 to fixedly clamp such slider against the bottom wall 82 of the tubular member 72 so as to rigidly fix the slider 74 within the tubular member 72. On the other hand, loosening the screw 80 relieves the downward pressure of the nut-like block 83 on the lips 75 and allows the slider 74 to be slid further into or further out of the corresponding end of the tubular member 72, so as to adjust the distance of the outer end of the slider 74 from the center of the tubular member 72 and hence from the center of the channel member 20.

The outboard end 84 of each slider 74 is angled outward and downward at approximately a 45° angle to the length of the slider 74 (to the horizontal) as seen in FIG. 2. Thus, the planes of the adjacent ends 73 and 84 of the tubular member 72 and corresponding slider 74 are in respective planes which are here at substantially right angle to each other (see the left end of FIG. 2).

Fixed atop the outer end portion of each slider 74, as by welding, is a length of angle member, as seen at 85. Each angle member 85 has a horizontal bottom leg 86 supported atop and welded to the outboard portion of the top wall of the corresponding slider 74. Each angle member 85 further has an upstanding leg 87 which rises from the outer end of the corresponding slider 74 and has a top portion 90 which is slightly bent outward. The two top portions 90 of the two angle members 85 thus slightly diverge as seen in FIG. 2 to form a funnel mouth facing upward to facilitate reception between the upstanding legs 87 of the above-mentioned dock beams 12 and 13, in the manner shown in FIG. 2. To facilitate the same reception, the upper corners of the upstanding legs 87 of the two angle members 85 are beveled as seen at 91 in FIG. 3.

In the preferred embodiment shown, the tops of the horizontal bottom legs 86 of the angle members 85 are substantially flush with the top of the tubular member 71, as best seen in FIG. 2, such that the beams 12 and 13, depending on their thickness, may be either entirely supported on the angle members 85 or may overlap on to the top of the tubular member 71.

The beams 12 and 13 may simply be allowed to rest, by gravity, upon the angle member legs 86. Optionally, the beams 12 and 13 may be connected by horizontal threaded rods (one, or as here shown in FIG. 1, two) 100 extending therethrough and spaced above the upstanding legs 87 of the sliders 74. Nuts 101 on the outer ends of each rod 100 are tightened enough to keep the beams 12 and 13 parallel to each other over time. Optionally, the upstanding legs 87 of the angle members 85 may be each provided with a horizontal through hole, as at 93 in FIGS. 1 and 3, for reception therethrough of a screw or bolt intended to penetrate the adjacent beam 12 or 13 to fix such beam to the support 10.

Although the operation of the apparatus has been indicated above, same will be briefly summarized below for convenience in reference.

OPERATION

Throughout the following discussion, assume that the top of the piling 11 is several feet above the maximum height to which the floor boards (planks) 16 must be raised to position same at the desired height above maximum water level.

If the supports 10 are to be placed during the initial construction of a dock, then the supports 10 can each be fixed to their corresponding pile 11 temporarily by hanging the loop 70 on a nail (not shown) at the desired height above present water level. With the swing lever 33 of the pile gripping unit 30 in its full open FIG. 6 position, the hooks 50 and 60 receive links of the elongated chain 66 wrapped loosely around the piling 11 in a substantially horizontal plane. An elongate lever member, such as a large crescent wrench (not shown) or an end slotted, rigid bar 94 (FIG. 5) is moved axially past the free edge 37 and receives the rear flange 38 of the angle element 36 in its elongate axially opening slot 95, as generally indicated in FIG. 5. With the lever 94 thus gripping the angle member 36, the lever 94 is pulled in a counterclockwise direction, as seen from the top, and as indicated by the arrow 96 in FIG. 6, to positively pivot the swing lever 33 from its FIG. 6 position through its FIG. 5 position and an over center into its FIG. 4 closed position. This tightens the chain 66 to tightly grip the pile 11 and force the points 26, and indeed the entire front edges 25, of the channel member 20 fixedly against the peripheral face of the pile 11. The grip of the chain 66, in the FIG. 4 over center position of the swing lever 33, is tight enough that the edges 25 and points 26 of the channel member 20 may slightly penetrate the peripheral face of the wood pile 11 so as to not only frictionally grip same but also somewhat mechanically interlock therewith. In any event, the support 10 is now fixed to the pile 11 in a manner to support easily the weight of the dock superstructure 12–16.

When the swing lever 3 reaches the FIG. 4 closed position, the lever 94 may be slid off therefrom and used to install another support 10 on a different piling 11.

While the swing lever 33 is stable in its closed, over center position of FIG. 4, for safety purposes and to avoid inadvertent clockwise opening of the swing lever 13, as by accidental collision with its leftward, free end in FIG. 4, a safety pin, or as here shown a safety wire, 65 is inserted through the aligned holes 63 and 64 in the fixed top plate 31 and swing lever upper plate 34 and secured, as indicated in FIG. 2, to positively prevent the swing lever 33 from swinging open.

Thereafter, the cap screws 80 can be loosened to allow the sliders 74 to be moved toward or away from each other so as to snugly receive thereon the corresponding beams 12 and 13 (FIGS. 1 and 2) which they are to support. The upstanding legs 87 of the angle members 85 are pressed toward each other manually to press the beams 12 and 13 snugly against the sides of the piling 11, whereafter the cap screws 80 are tightened to pull down the blocks 83 tightly against the lips 75 of the sliders 74 and thereby fix the sliders 74 with respect to the tubular member 73 in which they are telescoped. The support 10 now properly supports the beams 12 and 13 in fixed position at the desired height on the piling 11.

If desired, the nail (not shown) which penetrated the loop 70 into the pile 11, to temporarily support the support 10 at the desired height on the piling 11, can now be removed (or left in place if preferred for later removal if it becomes desirable to raise or lower the support on the piling 11).

Also, if desired, the threaded rod or rods 100 and corresponding nuts 101 may be installed as shown in FIG. 1, to keep the piling flanking beams parallel to each other.

Also, if desired, the beams 12 and 13 may be secured with respect to the support 10 by installation of screws 94 through the holes 93 in the upstanding legs 87 of the sliders 74, which screws 94 thread into the sides of the respective beams 12 and 13.

With all of the supports 10 so installed on their respective pilings 11, and the transverse beams 12 and 13 all in place upon such supports 10, and the joists 14 and planks 16 properly installed, the dock is completed.

Should the water level at the dock rise or fall a sufficient amount that it becomes desirable to change the height of the walkway defined by the beams 12 and 13, joists 14 and planks 16, the supports 10 may be repositioned as follows. First, if the water level has fallen and the supports 10 are to be moved downward, the beams 12 and 13 are temporarily supported in any desired manner. For example, spikes (not shown) can be driven horizontally into the pilings snugly under the bottom edges of the planks 12 and 13 to temporarily support same against dropping along the piling 11. On the other hand, if the water level has risen, and it is desired to raise the level of the walkway, then the beams 12 and 13 can be temporarily raised along the piling 11 by any convenient means, such as a conventional block and tackle, or "come-along" device, supported on or adjacent the top of the piling and gripping under the beams 12 and 13, or by means of a float deployed underneath the beams 12 and 13, or by any other convenient means.

To move the support 10 vertically along the pile, the pile gripping unit 30 is first loosened. This is done by engaging the free edge 37 of the rear flange 38 of the swing lever 33 with the lever 94 and swinging same counterclockwise (as seen from the top) from its closed FIG. 4 position over center past its FIG. 5 position and into its open FIG. 6 position, which loosens the chain 66 so that it no longer fixedly grips the pile 11. The chain 66 is sufficiently loose that, if it were desired to move the support 10 to a different pile 11, the hooks 50 and 60 could be disengaged, one at a time, from the chain 66. However, if the support 10 is merely to be moved up or down on the same piling 11, detachment of the chain 66 from the hooks 50 and 60 is not needed. Instead, and with any nail removed from the loop 70, the support 10 can be simply moved up and down along the pile 11 as permitted by the loose condition of the chain 66. Once in a desired vertical position on the pile 11, loop 70 may again be placed on a nail pounded into the pile to temporarily support the channel member 20. Alternatively, the support 10 may merely be manually held temporarily in place at the desired height on the piling 11.

The lever 94 is again engaged with the rear flange 38 of the angle member 36 of the swing lever 33 and is pivoted counterclockwise, in the direction of the arrow 96, as viewed from above, to pivot the swing lever 33 past its FIG. 5 position, its over center position, and into its closed position of FIG. 4 once again. This again tightens the chain 66 around the piling 11 and rigidly fixes the support 10 at the desired height on the piling 11 in the manner above discussed. The superstructure 12–16 of the dock, and particularly including the beams 12 and 13, is then allowed to move downward onto the sliders 74. With the aforementioned steps taken with respect to all supports 10 on all pilings 11, the dock is now in its new height position.

Such moving of the support 10 vertically on the piling 11 may be facilitated by prior loosening and subsequent tightening of the nuts 101 on the threaded rod or rods 100, if present, and/or prior removal and subsequent repositioning of the screws 94, if present.

This adjustment of the height of the walkway of the dock with respect to the pilings 11, by moving of the supports 10 up and down, can be done many times, if necessary, to accommodate the height of the walkway to water level over the passage of years.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An adjustable dock support for a dock of the kind having an upstanding piling and a load carrying part including a member to be supported on said piling, the dock support comprising:

elongate flexible means for at least partly enwrapping the piling at a desired height thereon;

base means for engaging a portion of the perimeter of said piling opposite said flexible means;

over center lever means pivoted with respect to said base means from an open position to a closed position and engageable with said flexible means for tightly enlooping said piling and therewith snugly gripping the piling with said base means and flexible means;

carrier means fixed with respect to said base means for supporting a load carrying member of the dock, in which said base means includes an upstanding channel member having a bight to be spaced from the piling and laterally spaced upstanding arms with free edges engageable with the perimeter of the piling for small area, high pressure gripping of the piling.

2. The apparatus of claim 1 in which said arms are plate-like and have lower ends tapered to form points for stabbing the periphery of the piling and therewith for positively blocking downward skidding of said support on the piling under the weight of the load carrying part of the dock.

3. An adjustable dock support for a dock of the kind having an upstanding piling and a load carrying part including a member to be supported on said piling, the dock support comprising:

elongate flexible means for at least partly enwrapping the piling at a desired height thereon;

base means for engaging a portion of the perimeter of said piling opposite said flexible means;

over center lever means pivoted with respect to said base means from an open position to a closed position and engageable with said flexible means for tightly enlooping said piling and therewith snugly gripping the piling with said base means and flexible means;

carrier means fixed with respect to said base means for supporting a load carrying member of the dock, in which said flexible means comprises an elongate chain, means adjustably connecting one end portion of said chain to one of said lever means and base means and means connection the other end portion of said chain to the other of said lever means and base means.

4. The apparatus of claim 1 in which said base means includes a substantially vertical pivot axis on which said lever means is pivoted, said lever means in its open position extending to one side away from said base means and in its closed position at least partly overlapping said base means.

5. The apparatus of claim 4 including connector means on said base means and lever means for engaging opposite end portions of said flexible means and thereby tensioning said flexible means by pivoting said lever means from its open to its closed position.

6. The apparatus of claim 5 in which said connector means are fixed respectively with respect to the free end of said lever means remote from said pivot axis and with respect to the other side of said base means.

7. The apparatus of claim 3 in which said means adjustably connecting comprise a chain hook flexibly supported with respect to said one of said lever means and base means for engaging different lengths of said chain for fitting the dock support to different piling diameters.

8. An adjustable dock support for a dock of the kind having an upstanding piling and a load carrying part including a member to be supported on said piling, the dock support comprising:

elongate flexible means for at least partly enwrapping the piling at a desired height thereon;

base means for engaging a portion of the perimeter of said piling opposite said flexible means;

over center lever means pivoted with respect to said base means from an open position to a closed position and engageable with said flexible means for tightly enlooping said piling and therewith snugly gripping the piling with said base means and flexible means;

carrier means fixed with respect to said base means for supporting a load carrying member of the dock; and installation assisting means for holding said dock support temporarily at a desired height on the periphery of the piling prior to tightening of said flexible means into fixed gripping relation with the piling, said installation assisting means comprising loop means upstanding above said carrier means and base means for receiving therethrough a nail laterally fixedly protruding from the perimeter of the piling and therewith for convenient temporary fixed hanging of said dock support at a desired height on the piling while tightening said flexible means into said fixed gripping relation with the piling, said dock support having a piling facing side opposite to said lever means, means fixing said loop means generally along said piling facing side of said dock support for placement close to the periphery of the piling.

9. An adjustable dock support for a dock of the kind having an upstanding piling and a load carrying part including a member to be supported on said piling, the dock support comprising:

elongate flexible means for at least partly enwrapping the piling at a desired height thereon;

base means for engaging a portion of the perimeter of said piling opposite said flexible means;

over center lever means pivoted with respect to said base means from an open position to a closed position and engageable with said flexible means for tightly enlooping said piling and therewith snugly griping the piling with said base means and flexible means;

carrier means fixed with respect to said base means for supporting a load carrying member of the dock, in which said flexible means comprises an elongate chain, swivel means supporting a first rapid release chain connector on a side of said base means remote from the pivot axis of said lever means on said base means, a flexible member supporting a second rapid release chain connector on the free end of said lever means for connecting said base means and lever means to links of said chain.

10. The apparatus of claim 9 in which the chain connectors comprise chain hooks.

11. An adjustable dock support for a dock of the kind having an upstanding piling and a load carrying part including a member to be supported on said piling, the dock support comprising:

elongate flexible means for at least partly enwrapping the piling at a desired height thereon;

base means for engaging a portion of the perimeter of said piling opposite said flexible means;

over center lever means pivoted with respect to said base means from an open position to a closed position and engageable with said flexible means for tightly enlooping said piling and therewith snugly gripping the piling with said base means and flexible means;

carrier means fixed with respect to said base means for supporting a load carrying member of the dock, in which said base means has fixed, vertically spaced, substantially horizontal plates, said lever means comprising a U-shaped lever including a vertical bight fixedly connecting first ends of vertically spaced, substantially horizontal legs disposed vertically between said fixed plates, the second ends of said legs being pivoted for substantially horizontal swinging on a vertical axis through said fixed plates.

12. The apparatus of claim 11 including safety holes in an adjacent fixed plate and leg and vertically alignable in the closed position of said lever means and means insertable through said aligned safety holes for positively blocking swinging open of said lever means.

13. The apparatus of claim 11 in which said bight comprises an L-shaped angle member with one flange aimed toward said base means and the other flange spaced from and substantially parallel to said base means.

14. The apparatus of claim 13 including a loop forming means fixed on the outside of said angle member and a relatively short flexible member engaging said loop, said short flexible member lying inboard of said pivot axis in the closed, pile gripping position of said lever means and elongate flexible means.

15. An adjustable dock support for a dock of the kind having an upstanding piling and a load carrying part including a member to be supported on said piling, the dock support comprising:

elongate flexible means for at least partly enwrapping the piling at a desired height thereon;

base means for engaging a portion of the perimeter of said piling opposite said flexible means;

over center lever means pivoted with respect to said base means from an open position to a closed position and engageable with said flexible means for tightly enlooping said piling and therewith snugly gripping the piling with said base means and flexible means;

carrier means fixed with respect said base means for supporting a load carrying member of the dock, in which said carrier means comprises right and left sliders with tops for supporting members of the load carrying part of the dock, and substantially horizontal track means fixed on said base means for laterally supporting said sliders for adjustment widthwise of said base means to support said dock members in straddling relation with respect to the piling, and means actuable to fix said sliders in desired positions on said track means.

16. The apparatus of claim 15 in which said track means comprise a tubular member, said sliders comprising substantially C-shaped members each with a longitudinal slot in the bottom thereof, releasable means connecting said tubular member and C-shaped members at said slot to fix said C-shaped members in desired location in said tubular member.

17. The apparatus of claim 15 in which said sliders each have an upstanding leg, the dock members to be sandwiched between said upstanding legs of said sliders.

18. The apparatus of claim 15 in which outer ends of said track means and sliders are beveled at opposite angles, the outer portions of said slider tops being raised to be flush with the top of the track means to enable support of a given dock member by either or both of the top of the track means and the top of the sliders.

* * * * *

UNITED STATES PATENT AND TRADEMARK OFFICE

CERTIFICATE OF CORRECTION

PATENT NO. : 5 172 881

DATED : December 22, 1992

INVENTOR(S) : Robert J. STEIN

It is certified that error appears in the above-identified patent and that said Letters Patent is hereby corrected as shown below:

Column 9, line 16; change "connection" to ---connecting---.

Column 11, line 19; after "respect" insert ---to---.

Column 9, line 19; change "claim 1" to ---claim 3---.

Signed and Sealed this

Twenty-third Day of November, 1993

*Attest:*

*Attesting Officer*

BRUCE LEHMAN

*Commissioner of Patents and Trademarks*